United States Patent [19]

Honda et al.

[11] Patent Number: 5,051,008

[45] Date of Patent: Sep. 24, 1991

[54] AUTOMATIC GAP ADJUSTING MECHANISM

[75] Inventors: Yoshito Honda; Takashi Suzuki, both of Fujisawa, Japan

[73] Assignee: International Business Machines Corp., Armonk, N.Y.

[21] Appl. No.: 498,173

[22] Filed: Mar. 23, 1990

[30] Foreign Application Priority Data

Mar. 4, 1989 [JP] Japan ..... 1-81582

[51] Int. Cl.[5] ..... B41J 11/20

[52] U.S. Cl. ..... 400/59; 400/56

[58] Field of Search ..... 400/55, 56, 59, 352, 400/356

[56] References Cited

U.S. PATENT DOCUMENTS

| | | | |
|---|---|---|---|
| 4,337,696 | 7/1982 | Komatsu et al. | 400/121 |
| 4,775,869 | 10/1988 | Minowa | 400/59 |
| 4,809,025 | 2/1989 | Noguchi | 346/154 |
| 4,929,102 | 5/1990 | Mizutani et al. | 400/56 |

FOREIGN PATENT DOCUMENTS

| | | | |
|---|---|---|---|
| 58-53465 | 3/1983 | Japan . | |
| 60-56202 | 4/1985 | Japan . | |
| 212372 | 10/1985 | Japan | 400/56 |
| 61-53075 | 3/1986 | Japan . | |
| 171377 | 8/1986 | Japan | 400/55 |
| 62-44480 | 2/1987 | Japan . | |
| 055177 | 3/1987 | Japan | 400/56 |
| 187063 | 8/1987 | Japan | 400/56 |

*Primary Examiner*—Edgar S. Burr
*Assistant Examiner*—Ren Yan
*Attorney, Agent, or Firm*—John S. Gasper; Laurence R. Letson

[57] ABSTRACT

A motor drives, through a gear train, a cam set to force the printhead of a wire matrix printer against the platen and record sheet(s) with a force great enough to cause the cam to stop rotating. Continued driving of the gear train causes one of the gears to be driven around another gear, relieving the drive force. A detection of the stopping of the cams causes the stopping of the drive motor and a slight reversal. This adjusts the head to paper gap regardless of the paper thickness.

3 Claims, 1 Drawing Sheet

AUTOMATIC GAP ADJUSTING MECHANISM

DETAILED DESCRIPTION OF THE INVENTION

1. Field of the Invention

This invention is related to a mechanism, which, in an impact printer, automatically adjusts the spacing or gap between the print head and the platen depending on the thickness of the printing paper, and more particularly, to an automatic gap adjusting mechanism which presses the print head against the platen having a printing paper mounted thereon, and thereafter moves it back in the reverse direction thereby to adjust the gap.

2. Prior Art

Various proposals have been made for a mechanism for automatically adjusting the gap in an impact printer depending on the thickness of the printing paper.

In the mechanism disclosed in Laid-Open Patent Application No. 60-56202, the rear end of a carriage is pivotally supported on a rotating shaft through a cam mechanism and pivots in the platen direction by rotation of this rotating shaft. This rotating shaft is coupled with a drive motor through a unidirectional clutch and always spring-biased in the direction of swinging the carriage toward the platen. Prior to the print operation, the motor is rotated to the slack side of the unidirectional clutch, so that the carriage is caused to swing by the spring bias force toward the platen to allow the print head on the carriage to abut upon the printing paper. Thereafter, by rotating the motor in reverse by a predetermined amount to allow the carriage to move back by the amount corresponding to the amount of that reverse rotation, the spacing between the print head and the printing paper is kept constant.

In this mechanism, the print head is pressed against the platen by the spring bias force, but this spring bias force is susceptible to change depending on the extent of expansion and contraction of the spring. For instance, since the spring bias force or the force of pressing the print head becomes large when the form thickness is large, the size of the gap obtained by rotating the drive motor in the reverse direction by a fixed amount becomes smaller than a predetermined size, so printing of good quality is not obtained.

Also, in the mechanism disclosed in Laid-Open Patent Application No. 60-212373, one end of a carriage is pivotally supported on a rotating shaft, which is coupled with a drive motor through a cam mechanism and a slip clutch When the cam mechanism raises the rotating shaft as the drive motor rotates, the carriage is pivoted to cause the print head to abut on the printing paper. And, when the pressing force of the print head increases, slip occurs in the slip clutch and no more drive force is transmitted to the print head. Thereafter, the drive motor is rotated in reverse by a fixed amount to move the carriage backward thereby obtaining a gap of a predetermined size.

In the mechanism that transmits the drive force through the slip clutch, the magnitude of the slip torque fluctuates easily, and accordingly, the maximum pressing force of the print head fluctuates easily. Therefore, the size of the gap differs from printer to printer and, in addition, the correction thereof is very difficult. Also, the slip torque readily changes with time. It is thus difficult to always obtain printing of good quality.

Problems to be Solved by the Invention

As described above, in the prior art, there was a problem in which the pressing force of the print head easily fluctuated because a spring or slip clutch was used as a means for pressing the print head against the printing paper on the platen, so variation also easily occurred in the size of the gap obtained by moving back the print head by a predetermined amount.

It is the object of this invention to provide a novel mechanism wherein the print head can always provide a fixed pressing force to the printing paper regardless of the form thickness and an optimum gap can be obtained by moving back the print head by a predetermined amount.

Means and Action for Solving the Problems

This invention utilizes a planet gear mechanism for accomplishing the above-mentioned object. That is, a sun gear coupled with a rotating shaft for driving the carriage toward the platen through a cam mechanism is engaged with a planet gear engaging with a drive source, and the planet gear is held by a spring bias force so that the engagement with the sun gear is in a power transmission state. Accordingly, when the print head presses the platen, a reaction force acts on the rotating shaft to stop the rotation thereof, and when the reaction force becomes greater than the spring bias force, the planet gear starts to move along the perimeter of the sun gear against the bias force and the power transmission state is lost, so that the drive force from the drive source is not transmitted to the rotating shaft and the rotation of the rotating shaft stops. Therefore, the pressing force of the print head applied to the platen when the rotating shaft stops its rotation is always of a fixed magnitude which depends on the spring bias force applied to the planet gear, and the magnitude does not vary since it has no relation to the form thickness.

Further, when the rotation of the drive source is reversed after the stopping of the rotating shaft, the planet gear is engaged again with the drive source in the power transmission state by the spring bias force, so the rotating shaft rotates in reverse by the magnitude corresponding to the reverse rotation amount of the drive source to return the print head, whereby a gap of the size corresponding to the reverse amount of the rotation is always obtained.

EMBODIMENT

Figure 1:
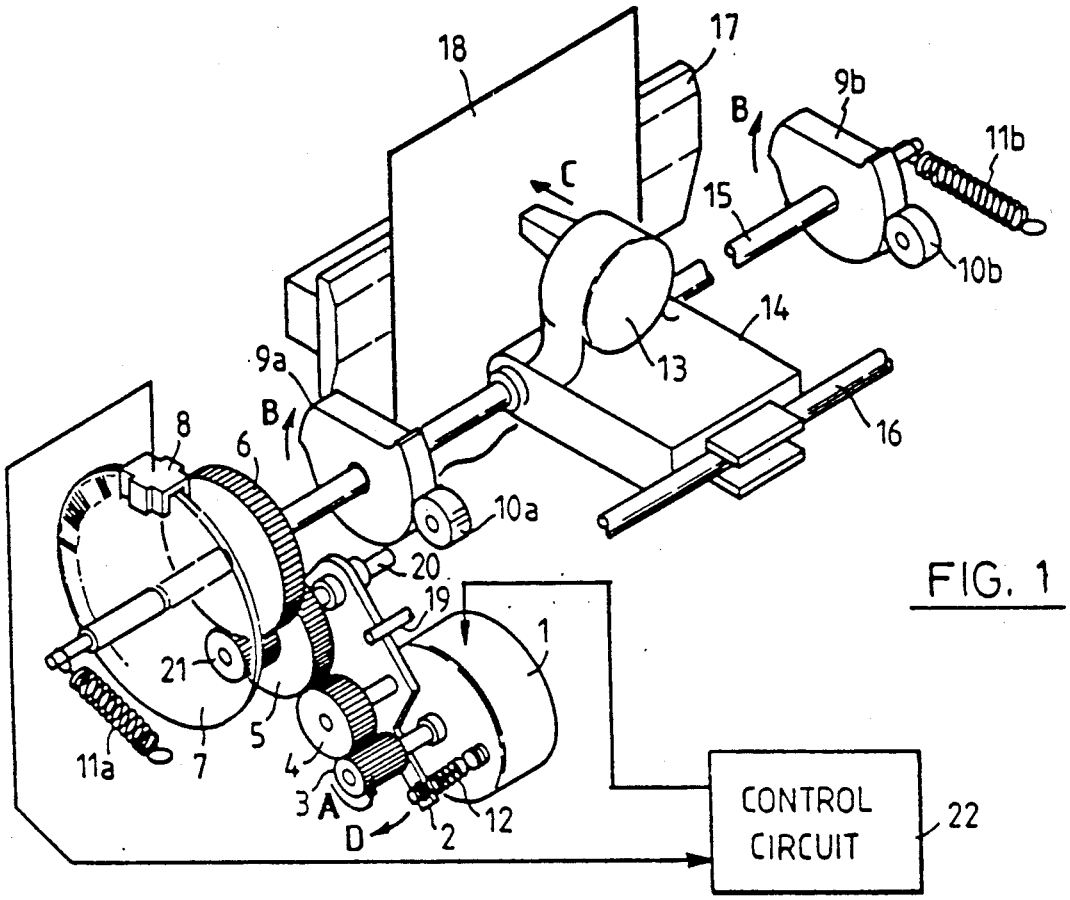
FIG. 1 is a perspective view showing the automatic gap adjusting mechanism of this invention.
Figure 2:
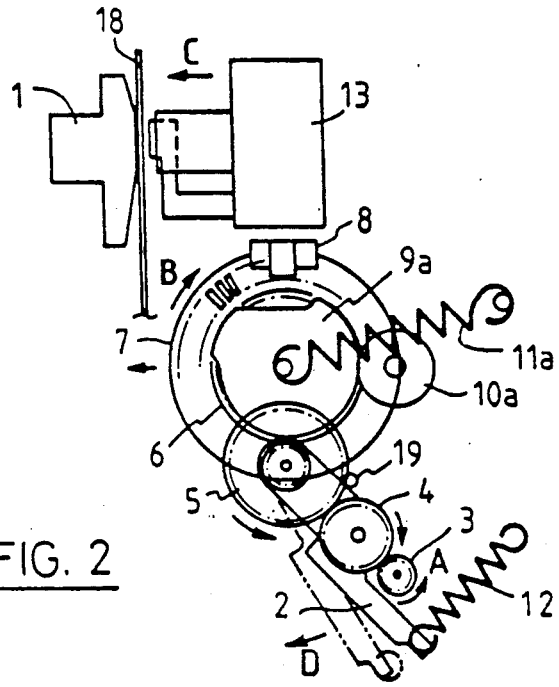
FIG. 2 is a schematic side view of the automatic gap adjusting mechanism as shown in FIG. 1.

The embodiment of this invention is described with reference to FIG. 1 and FIG. 2. The same parts in FIG. 1 and FIG. 2 are represented by the same reference numerals.

Since this invention relates to the automatic gap adjusting mechanism in impact printers, only the portions directly pertinent to this invention are shown in the drawing.

A drive motor 1 capable of forward and reverse rotating constitutes a rotational drive source along with a gear 3 attached to the shaft of the motor 1, and is fixed to a frame. A lever 2 is attached to the frame so that it can pivot on a shaft 20, and a planet gear 4 is provided on the lever. On the shaft 20, a gear 5 acting as the sun gear for the planet gear 4 is provided. The lever 2 is given a bias force by a spring 12 so that the gear 4 engages with the gear 3, and it is prevented from swinging over a predetermined amount by its abutting on a stopper 19. Also, the gear 5 is coupled with a rotating shaft 15 through a gear 21 attached to the shaft 20 and a gear 6. The rotating shaft 15 pivotally supports a carriage 14 having a print head 13 mounted thereon for lateral sliding, and the carriage 14 is supported by a fixed shaft 16 at the rear end thereof for lateral sliding and for floating to a platen 17 and a printing paper 18. Further, the rotating shaft 15 is provided with cams 9*a* and 9*b*, the surfaces of which are abutting on fixed rollers 10*a* and 10*b*. The rotating shaft 15 is provided, in both ends thereof, with springs 11*a* and 11*b*, which act so as to push the rotating shaft 15 or to press the cams 9*a* and 9*b* against the roller 10*a* and 10*b*. In addition, to the rotating shaft 15, an encoder disk 7 is attached which is provided with many slits in the periphery thereof, and a sensor 8 detects those slits. A control circuit 22 receiving the output of the sensor 8 is a typical control circuit, which detects the rotation amount and the stop of rotation of the rotating shaft and generates a control signal accordingly.

Now, the operation of this automatic gap adjusting mechanism is described. At the start of a printing operation, the carriage 14 is first positioned at the left end of the printing paper, or the left margin of the printing paper 18, and is retracted to the utmost end, that is, the rotating shaft 15 rotates so that the lowest portions of the cam surfaces of the cams 9*a* and 9*b* are in contact with the rollers 10*a* and 10*b*. At this time, the spacing between the print head 13 and the platen is about 1.5 mm. Then, when the drive motor 1 is rotated in the direction of A, its driving force is transmitted through the gears 3, 4, 5, 21 and 6 to the rotating shaft 15 to rotate it in the direction of B. Thus, the cams 9*a* and 9*b* gradually come in contact with the rollers 10*a* and 10*b* at the higher surfaces thereof to thrust the rotating shaft 15 and the carriage 14 forward, or in the direction of C. By the thrusting of the rotating shaft 15, the gear 6 also moves in the direction of C, but the distance between the centers of the gears 6 and 21 makes little change so that the engagement of those gears is maintained. Soon, the leading edge of the print head 13 abuts on the printing paper 18, and presses it against the platen 17. Accordingly, the print head 13 receives a reaction force from the platen 17 through the form 18, and the reaction force functions to suppress the rotation of the gear 5 through the carriage 14, the rotating shaft 15, and the gears 6 and 21. Thus, as the reaction thereof, the gear 4 receives the reaction force of the reverse rotation moment and simultaneously receives the forward rotation moment by the drive motor 1, thereby producing a drive force of the direction of D, which is transmitted to the lever 2 through the shaft of the gear 4. This drive force increases as the print head 13 continues to press the platen 17, and soon drives the lever 2 in the direction of D against the spring 12, so the lever 2 pivots on the shaft 20. Therefore, the gear 4, being engaged with the gear 5, moves in the direction of D with the gear 5 as the sun gear, so that the drive force from the motor 1 is prevented from being transmitted to the gear 5 and the rotation of the rotating shaft 15 stops. Since the stopping of the rotation of the shaft 15 is caused when the gear 4 slightly moves in the direction of D as the planet gear, the engagement of the gear 3 and the gear 4 is maintained at the time of stopping the rotation. When the control circuit 22 detects the stop of rotation by means of the signal from the sensor 8, it stops the drive motor 1 and immediately rotates the motor 1 by a fixed amount in the reverse direction.

When the stop of the rotation of the drive motor 1 is transmitted to the planet gear 4 through the gear 3, the drive force of the direction of D in the gear 4 disappears, so that the gear 4 is rotated in the reverse direction along the teeth of the sun gear 5 until the lever 2 is caused to swing in the direction reverse to D by the spring 12 and to return to the position at which it abuts on the stopper 19. Then, when the drive motor 1 rotates in the reverse direction, the drive force of that reverse rotation is transmitted back to the rotating shaft 15 through the planet gear 4, and the carriage 14 is returned backward by a fixed distance corresponding to the fixed amount of reverse rotation of the drive motor 1. In this embodiment, the drive motor 1 is rotated in the reverse direction by the amount corresponding to this distance or the return amount of the carraige equal to 0.3 mm. Therefore, the leading edge of the print head 13 is always set to be spaced apart from the printing paper 18 by a fixed distance independently of the form thickness. By performing the print operation with this condition, uniform printing of good quality is always achieved.

Incidentally, the position at which the print head 13 abuts on the printing paper 18 and stops relies on the maximum torque when the rotation of the rotating shaft 15 stops, and hence, on the bias force of the spring 12. Accordingly, by adjusting the length of the spring 12, the variation in the printing quality from printer to printer can be corrected. In addition, in this embodiment, after the print head abuts upon the printing paper, the print head is always moved back by a fixed distance, 0.3 mm, for performing the print operation, and the use of this invention also enables the automatic adjustment of the spacing between the print head and the printing paper to be performed precisely according to the form thickness. That is, the amount of the movement made by the print head until the print head abuts on the printing paper and stops can be measured by the output of the sensor 8, and the thickness of the printing paper can thus be measured. By controlling the amount of the reverse rotation of the drive motor 1 according to the measured form thickness, a precise amount of automatic gap adjustment is enabled.

Advantages of the Invention

In accordance with this invention, since the maximum pressing force always becomes constant independently of the thickness of the form when the print head is made to abut on and pressed against the printing paper and moved back in the reverse direction, the size of the gap obtained by moving back the print head by any predetermined distance can be measured accurately, whereby printing of good quality can always be obtained.

We claim:

1. In an automatic gap adjusting mechanism which presses a print head against a platen having a printing paper mounted thereon, and thereafter moves back said print head away from said platen thereby to adjust the gap between said platen and said print head, said automatic gap adjusting mechanism comprising:

a carriage having said print head mounted thereon;

a drive source for generating forward and backward rotational drive forces, a planet gear coupled with said drive source, a sun gear coupled with said drive source, through said planet gear, and, a rotatable shaft carrying a cam mechanism and coupled to said sun gear for supporting said carriage so as to drive said carriage in the direction toward said platen by means of a cam mechanism, a bias means for providing said bias force to said planet gear so that said planet gear maintains engagement with said drive source in a power transmission state.

2. An automatic gap adjusting mechanism as set forth in claim 1, comprising:

a detecting means coupled with said rotatable shaft for detecting the stopping of rotation of said rotating shaft, and a control means responsive to said detecting means for generating a rotational drive force in the direction opposite to that of said drive source.

3. An automatic gap adjusting mechanism as set forth in claim 1 further comprising a rotational lever, pivoted about the axis of said sun gear and wherein said bias means provides a bias force to said planet gear through said rotatable lever.

* * * * *